US006578224B1

(12) United States Patent
Lawson et al.

(10) Patent No.: US 6,578,224 B1
(45) Date of Patent: Jun. 17, 2003

(54) PROCESS OF CLEANING CARPETS AND THE LIKE

(75) Inventors: John Russell Lawson, Cincinnati, OH (US); Marcel Vanderbroek, Grimbergen (BE); Jelle Dankert Vuijk, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/553,038

(22) Filed: Apr. 20, 2000

Related U.S. Application Data

(62) Division of application No. 09/485,031, filed as application No. PCT/US99/07347 on Apr. 7, 1999.

(30) Foreign Application Priority Data

Apr. 8, 1998 (EP) ..... 98870073
Nov. 9, 1998 (EP) ..... 98870243

(51) Int. Cl.[7] ..... D06B 1/02
(52) U.S. Cl. ..... 8/158
(58) Field of Search ..... 239/337, 340, 239/346, 154, 332, 532, 530, 119; 15/320, 321; 8/158

(56) References Cited

U.S. PATENT DOCUMENTS

| | | | | | |
|---|---|---|---|---|---|
| 2,257,585 | A | * | 9/1941 | Auvil | 239/530 |
| 2,789,031 | A | * | 4/1957 | Caronia | 8/158 |
| 2,884,206 | A | * | 9/1959 | Dukes | 239/530 |
| 3,754,709 | A | | 8/1973 | Laatsch | |
| 3,904,116 | A | * | 9/1975 | Jones et al. | 239/332 |
| 4,013,225 | A | | 3/1977 | Davis | |
| 4,580,309 | A | | 4/1986 | Ogden | |
| 4,618,099 | A | * | 10/1986 | Nagao et al. | 239/332 |
| 4,790,454 | A | * | 12/1988 | Clark et al. | 239/332 |
| 4,801,088 | A | * | 1/1989 | Baker | 239/332 |
| 4,925,105 | A | * | 5/1990 | Lin | 239/154 |
| 5,113,547 | A | | 5/1992 | Mayhew | |
| 5,716,076 | A | * | 2/1998 | Tamborini et al. | 15/321 X |
| 5,836,046 | A | * | 11/1998 | Huffman et al. | 15/321 |

FOREIGN PATENT DOCUMENTS

| | | |
|---|---|---|
| EP | 0 253 910 B1 | 1/1988 |
| EP | 0 672 377 B1 | 9/1995 |
| EP | 0 847 721 A2 | 6/1998 |
| EP | 0 949 006 A1 | 10/1999 |
| GB | 2 232 068 A | 12/1990 |
| GB | 0 323 422 A | 9/1998 |
| WO | WO 95/15220 | 6/1995 |

* cited by examiner

*Primary Examiner*—Philip Coe
(74) *Attorney, Agent, or Firm*—Thibault Fayette; James C. Vago; Kim William Zerby

(57) ABSTRACT

The present invention is directed to a process of cleaning carpets and other large fabric coverings with a product dispensed from a device. The device comprises a reservoir for the product, means for dispensing the product, a spray arm and at least one dispensing opening. The reservoir is a removable non-refillable cartridge. Preferably, the reservoir comprises at least one compartment.

11 Claims, 9 Drawing Sheets

PROCESS OF CLEANING CARPETS AND THE LIKE

This application is a divisional of copending U.S. application Ser. No. 09/485,031 filed Feb. 2, 2000, which is a 371 of PCT/US99/07347 filed Apr. 7, 1999.

FIELD OF THE INVENTION

The present invention relates to a process of cleaning carpets and other large fabric coverings with a product dispensed from a device.

BACKGROUND OF THE INVENTION

Trigger spray devices are known for the purposes of domestic cleaning, for example for cleaning hard surfaces such as windows, baths and ovens, as well as for spot cleaning of floor coverings such as carpets. Most trigger spray devices which are commercially available are manually activated, that is to say that the devices comprise a trigger which is activated by hand by the consumer. Most commonly this manual activation generates liquid pressure in a chamber by means of a positive deplacement pump by means of a positive deplacement pump which in turn drives the liquid from the chamber usually through a dispensing nozzle. Many dispensing patterns are possible, but a conical spray is the most common.

Large surfaces, such as carpets and other floor coverings are, however, difficult to treat with a hand activated trigger spray device. The large surface area demands repeated manual activation of the device many times. This is laborious, and usually results in an uneven application of product over the whole of the surface.

An electrically activated sprayer is known from U.S. Pat. No. 3,993,250, issued on Nov. 23, 1976, however there is no suggestion that this sprayer could be used for the purpose of cleaning surfaces such as carpets. Furthermore while this sprayer could take some of the laborious work out of the task when compared to manually activated trigger sprayers, it still does not fully address the problem of uneven application of product over the whole surface of the carpet or floor covering.

An extended arm is known from U.S. Pat. No. 3,904,116, issued on Sep. 9, 1975. This device is taught principally for use with the application of insecticides.

The object of the present invention is to provide a process of cleaning carpets and other large fabric coverings with a product dispensed from a device, said device comprising a reservoir designed so that it is possible to change the product used with the same appliance, i.e. allows the consumer to use several products with the same appliance—for example by using a carpet cleaning kit with one device for dispensing a product and several reservoirs containing different products—.

A further object of the present invention is to provide a process of cleaning carpets and the like with a product dispensed from a device, said device comprising a reservoir that avoids the consumers putting the wrong product in the appliance, so as to avoid human safety and/or surface safety issues.

SUMMARY OF THE INVENTION

The present invention is directed to a process of cleaning carpets and other large fabric coverings with a product dispensed from a device, said device comprising a reservoir for said product, means for dispensing said product, a spray arm and at least one dispensing opening, the process being wherein the reservoir is a removable non-refillable cartridge. Preferably, said at least one reservoir comprises at least one compartment.

BRIEF DESCRIPTION OF THE DRAWINGS

FIG. 8 D shows the cylinder in place in its housing with rubber joints for leak-tightness positioned on the sides, and the flow-control rotating button.

DETAILED DESCRIPTION OF THE INVENTION

Figure 1:
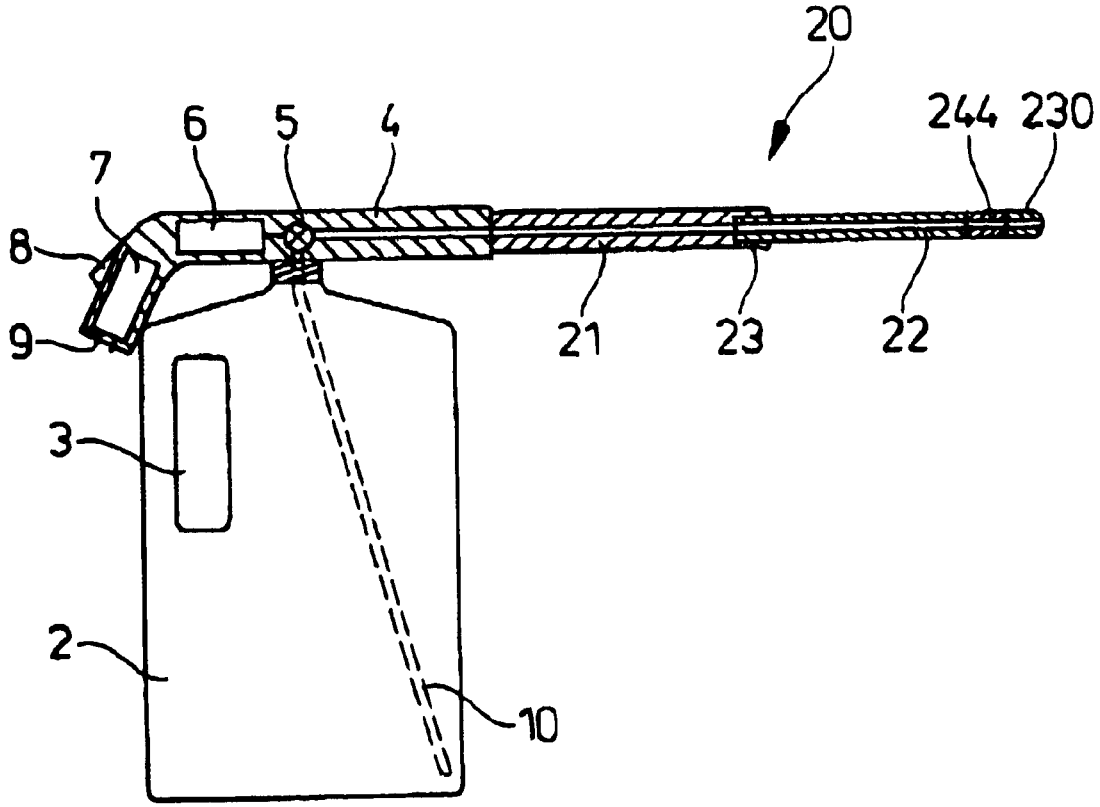
FIG. 1 shows a diagrammatic representation of a device having an extendible spray arm.

The present invention is directed to a packaged product. Said packaged product comprises the combination of a product, for example a liquid composition within a reservoir, with a means for delivering the product. Said product delivering means preferably comprises a housing, a dispensing means such as a spraying arm, and a means for conducting product from the reservoir to the spraying arm.

It is a preferred feature of the packaged product of the present invention that the product delivering means comprises a manually or electrically driven pump. More preferably, said product delivering means comprises an electrically driven pump which is used to pump product from the reservoir through the spraying arm and out of the product dispensing opening (or openings) located in the spraying arm to the surface to be treated. In this way, the product delivering means connected to a reservoir constitutes an electrical spraying device. The product dispensing openings are preferably nozzles which are selected so that the sprayed product takes the form of a continuous stream or film, or of a discontinuous stream or film of fine particles, or of a mist, or of a foam. It is most preferred that the spray pattern is in the form of fine particles because this is the most efficient way to cover a large surface area with a small volume of product with an even coverage. Typically the product output is from about 20 ml/minute to about 400 ml/minute, and preferably from about 150 ml/minute to about 250 ml/minute, the product being typically suitable for carpet cleaning. The packaged product of the present invention is to be used for example for spraying household cleaning or laundry products, or perfumes. In a preferred embodiment, the packaged product is a cleaning solution used for the cleaning of surfaces such as fabrics, carpets, floors, and ceilings.

It is preferred that the spray arm has one nozzle, but it may also have multiple nozzles located along its length. The spray arm makes it easier to control where the cleaning product is sprayed. For example, when cleaning carpets the spray arm makes it easier to avoid spraying product onto furniture and walls, and also enables access into corners which would otherwise be difficult to reach. Furthermore, an ergonomically designed spray arm avoids the need for the user to have a bent back when spraying.

The Product Delivering Means

The product delivering means comprises a means for conducting the product from the reservoir through the spray arm, to the product dispensing opening from which said product is dispensed. Said means for conducting the product is connected to the reservoir and to the spray arm, for example via pipes, which can be for example flexible plastic pipes. The means for conducting the product from the reservoir to the spray arm is preferably contained into the housing, as well as the pipes, if any.

In a particularly preferred embodiment of the present invention, the means for conducting the product from the reservoir through the spray arm to the product dispensing opening comprises an electrically driven pump. The electrically driven pump may be, for example, a gear pump, an impeller pump, a piston pump, a screw pump, a peristaltic pump, a diaphragm pump, or any other miniature pump. In the preferred embodiment the pump is a gear pump with a typical speed between 6000 and 12000 rpm.

The electrically driven pump must be driven by a means such as an electric motor. The electric motor typically produces a torque between 1 and 20 mN.m. The electric motor must, in turn be provided with a power source. The power source may be either mains electricity (optionally via transformer), or it may be a throw-away battery, or rechargeable battery. Most preferred are one or more AA rechargeable or disposable batteries, the batteries being housed in the package. The voltage output of the battery is typically between 1.5 and 12 Volts, with a preferred output between 3 and 6V.

In one embodiment of this invention, the pump is designed to be reversible, so that it can dispense liquid from the reservoir, and suck liquid from a surface, or only from the pipes of the product delivering means, back into the same or preferably another reservoir. Typically, only small amounts of liquid can be sucked back from a surface, and such a reversible pump is not intended to replace the use of a vacuum cleaner. Several ways of inverting the rotation of the pump can be used. In one example, the pump and motor are linked to a timer and an electronic circuit, such that after a defined time (eg. 15 seconds) the motor is not used, it automatically starts again, and its rotation side is reversed. As a result, the remaining product in the tubing and the extension of the product delivering means is sucked back into the reservoir. As a consequence when replacing a product by another one, it is easy to change the product without mixing new and old products. For example, the consumer can use the product delivering means for dispensing a first type of composition, then wait for the pump to suck back said first composition from the pipes, and then change the reservoir or its contents to dispense a second composition without mixing of the two compositions inside the pipes.

The Handling Means

The packaged product according to the present invention is preferably hand-held, and therefore preferably comprises a holding means, which is more preferably integrated to the housing of the product delivering means. The holding means may be any sort of handle which will allow the user to pick up the packaged product and to carry it to the place where the spraying is to be carried out. The handle can be part of the reservoir or of the housing of the product delivering means. It is likely that the packaged product will be carried around a whole room when a carpet is being cleaned. The handle may be a simple protrusion or indentation which may be gripped by the user, or it may be a more sophisticated design for ergonomic reasons.

In one alternative embodiment of the present invention, the housing of the product delivering means comprises a means allowing the user to carry it without using hands. In a first example, the housing comprises a clip which allows the user to hang said housing to a belt. In another example, the housing comprises at least one shoulder strap which allows to carry said housing on the shoulder/back. Other such means may be applied which allow the user to use both hands for other tasks.

The Reservoir

The product delivering means comprises at least one reservoir which can be of any type capable of containing a product under liquid form—by liquid it is meant to include embodiments when the product comprises a solid and a solvent for progressively dissolving said solid. Also included are liquids comprising small particles in suspension—. Said reservoir is preferably located into the housing of the product delivering means, and can be made out of any suitable material, such as metal, alloy, glass, but is preferably made out of plastic. It comprises at least one compartment comprising at least one composition.

The at least one reservoir can be fixed into the housing of the product delivering means, and then, preferably comprises one opening, more preferably a reclosable opening. Alternatively, the at least one reservoir can be removable from the housing of the product delivering means, so that it is replaceable when empty, or it can be refilled, for example with tap water.

In a first embodiment, the product delivering means comprises one reservoir with one compartment, comprising one or more composition(s), preferably one composition.

In a second embodiment, the product delivering means comprises one reservoir with at least two different compartments, each of which can comprise different compositions, for example non-miscible compositions or two chemically reacting solutions which react once mixed. Such a reservoir is made for example by an extrusion blowing process.

In a third embodiment, the product delivering means comprises at least two separate reservoirs. These reservoirs can have different shapes, for example they can be designed with complementary shapes. Alternatively, different reservoirs can be plugged into the product delivering means at different locations. Said reservoirs can comprise one or more compartments comprising same, but most preferably different products.

In a forth embodiment, the product delivering means comprises at least one portion for connecting a reservoir comprising a liquid such as a solvent or water, and at least one additional portion for connecting a small cartridge of a concentrated composition, for example under liquid, gel or granulated form. At the time the consumer uses the product delivering means, the composition contained into the cartridge will be dissolved into the solvent or water, and the resultant active liquid composition will be dispensed through the spray nozzle. Alternatively, said cartridge is connected directly into one portion of a reservoir. The cartridge can be for example screwed into an appropriate opening of the housing, or of the reservoir. It comprises a seal portion, such that when fully screwed, it sealably closes said appropriate opening.

In all of the preceding embodiments when the product delivering means comprises more than one reservoir. The proportion of product pumped can differ from one reservoir to another. For example, this is achieved by selecting pipes of different diameters for a reservoir and another, or by adding a flow-control means to the pipes between one reservoir and the pump.

In another embodiment, the present invention is a kit comprising the product delivering means and at least one reservoir comprising a product. Preferably, the kit comprises the product delivering means and a set of several removable reservoirs, each comprising a different product. The different products can be products for treating different areas such as carpets, kitchen surfaces, bathroom surfaces, cars or else.

The Spray Arm

The product delivering means is connected, preferably removably connected, to a spray arm. The spray arm can have a pre-determined length. However such a spray arm can be difficult to store, and the spray arm is preferably extendible/retractable either by means of telescopic or foldable configuration. A telescopic configuration can be a liquid tight telescopic mechanism, or can have a tube running inside. A preferred embodiment is hereafter described in detail.

The extendible spray arm (220) comprises a handle (231), to which is connected a telescopingly extendible wand (232) of the spray arm, and a dispensing tube (233) which is movably attached to said spray arm (220). Preferably, the spray arm (220) further comprises a dispensing nozzle, which is more preferably a spraying nozzle (230).

The length of the telescopingly extendible wand (232) is reduced to less than 15 cm, preferably less than 10 cm, more preferably less than 7 cm, when it is in collapsed configuration, while said telescopingly extendible wand (232) can be extended to more than 50 cm, preferably more than 70 cm when the spray arm (220) is in its fully extended configuration. At the same time, the external and greatest diameter of the spray arm (220) does not exceed 5 cm, preferably not more than 3.5 cm.

Figure 3:
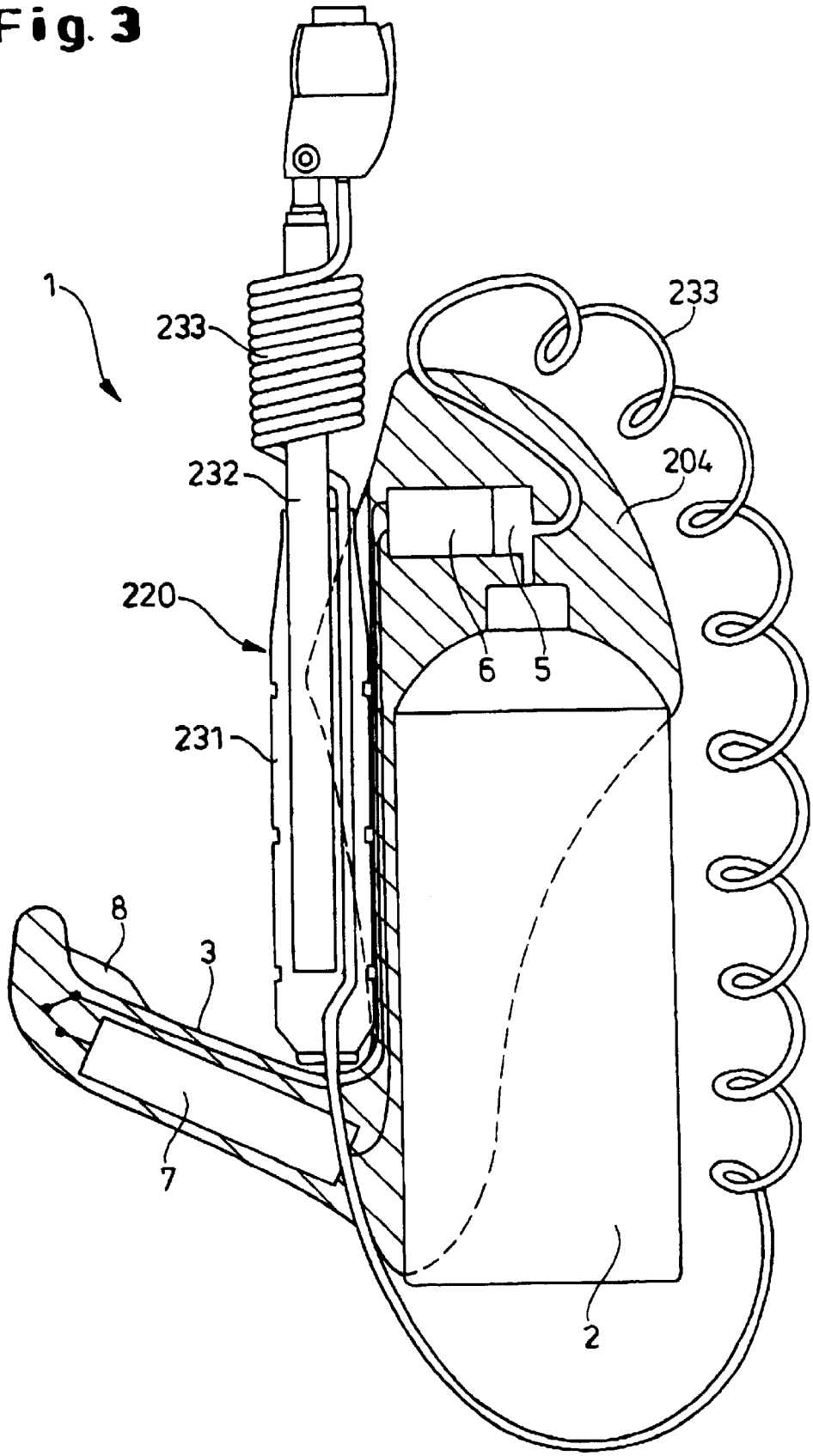
FIG. 3 shows a diagrammatic representation of a device which is an alternative embodiment of the invention.
Figure 4:
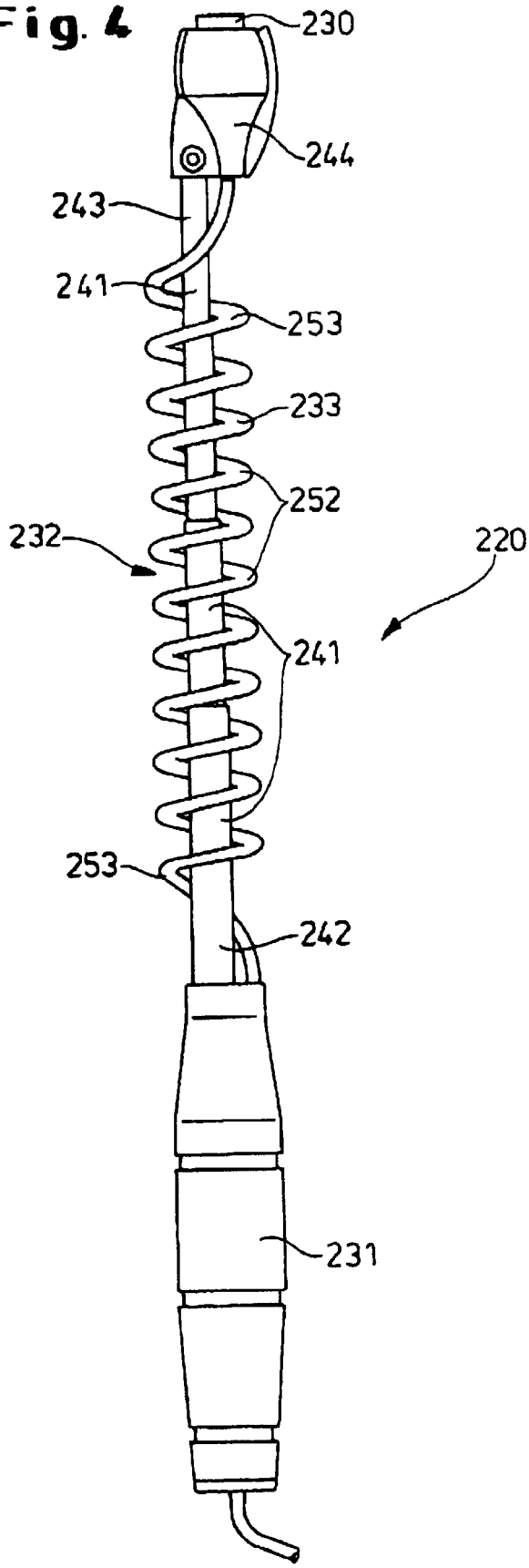
FIG. 4 shows the liquid-applying spray arm with tubing coiled outside the telescopingly extendible wand, said spray arm being in the extended configuration.
Figure 5:
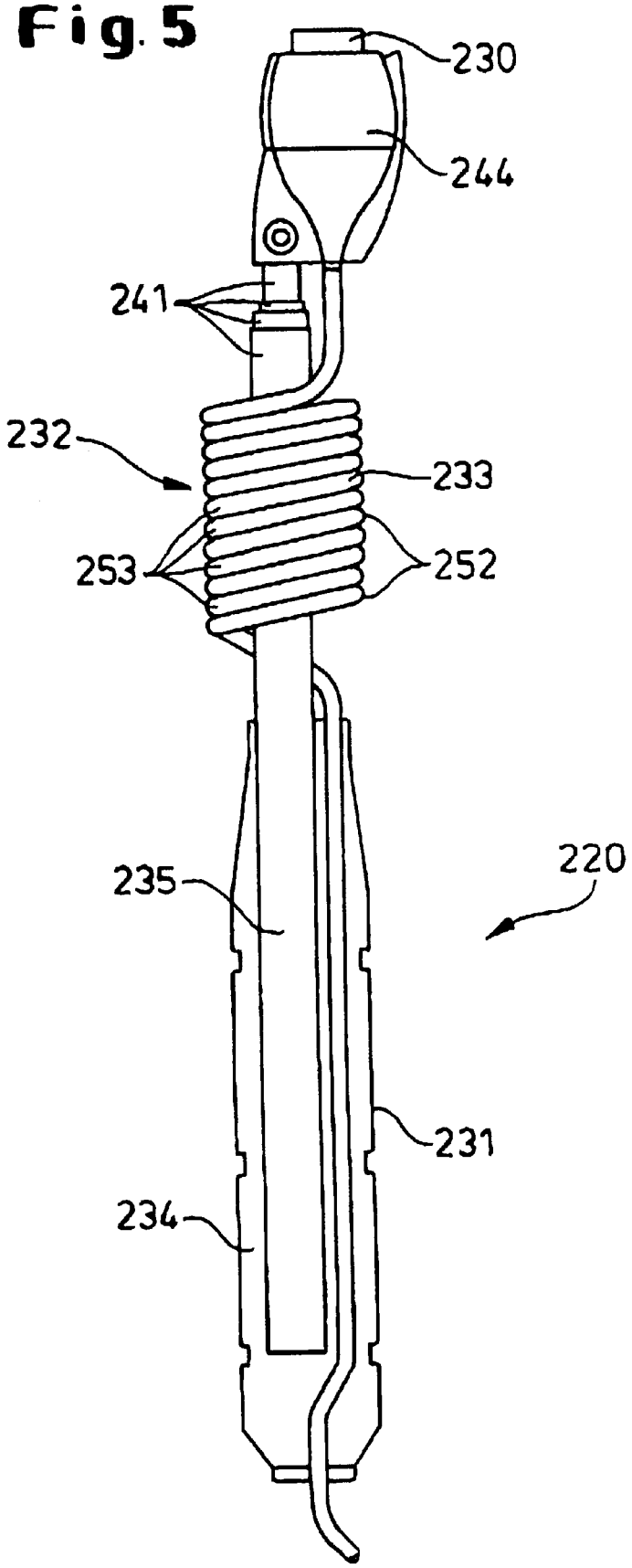
FIG. 5 shows the liquid-applying spray arm with tubing coiled outside the telescopingly extendible wand, said spray arm being in the collapsed configuration.

The spray arm (220) firstly comprises a handle (231), as shown in FIGS. 3, 4 and 5, which is the most proximal element of said spray arm (220), i.e. the element which is the closest from the user during use. It has an elongate shape, and can be made out of any suitable material such as plastic, metal, alloy, cork, or a combination of several materials, but preferably, the external surface of the handle (231) is coated with an anti-slip, rubber-like material. In a preferred embodiment of the present invention, the handle (231) comprises a hollow portion (234) inside which the dispensing tube (233) is positioned. This hollow portion (234) is a cylindrical channel whose diameter is slightly superior to the external diameter of the dispensing tube (233). This channel is more preferably located along the great length of the handle (231). Preferably, the handle's length is less than 20 cm, more preferably less than 15 cm.

Once the dispensing tube (233) of the spray arm (220) is connected to the source of liquid, the spray arm (220) can be detached from said source of liquid before use, or alternatively, it can stay attached to said source of liquid, for example, it can be used while integrated to said source's main body. Preferably, the extendible spray arm is removably secured to the source of liquid, such that it can be detached at all times, for example to be arranged separately from the main body of the product delivering means.

The handle (231) comprises a recess into which at least one portion (235) of the telescopingly extendible wand (232) is located when the spray arm (220) is in its collapsed configuration, as shown in FIG. 5. Preferably, the length of the telescopingly extendible wand's portion which is protruding from the handle (231), when said telescopingly extendible wand (232) is in full collapsed position, i.e. the portion which is not arranged within said handle (231), is less than 50%, preferably less than 25%, of the total length of said telescopingly extendible wand (232) in collapsed position. In this way, while the user benefits from the complete length of the telescopingly extendible wand (232), i.e. the substantially combined length of all segments of said telescopingly extendible wand (232), she/he can benefit from a collapsed spray arm (220) with a very short length.

Optionally, and while the spray arm (220) is framed such as to be as light as possible, the handle (231) comprises a counterweight which is either a separate element which is releasably connected, for example clipped or screwed, to said handle (231), or which is integrated to said handle (231). Said counterweight may be useful in case the weight of the device's distal end increases, for example when in extended position, and/or during use when the dispensing tube (233) is filled with liquid.

Optionally, the spray arm (220) further comprises a means (236) for controlling the flow of liquid which is dispensed through the nozzle member (10). Preferably, the flow-control means (236) is integrated to the handle (231), however, it can also be integrated to the main body of the liquid dispenser (or product delivering means), for example to the main body of an electrical sprayer.

In a first embodiment of the present invention, the flow-control means (236) has the shape of a turning piston (237) which is pierced by a channel (238) through which the liquid is free to flow. The turning piston (237) is rotateably inserted into a cylinder (239), as shown in FIGS. 8A to 8D. The flow-controlling means (236) is further provided with rings (240) for leak-tightness which are made for example out of a natural or synthetic rubber-based material, or Teflon®. The cylinder (239) is connected to the dispensing tube (233), such that when the channel (238) of the turning piston (237) is aligned with the tube, the flow-control means (236) is in its full dispensing position. When the user turns the piston into the cylinder (239), the flow of liquid is reduced, or even completely stopped when the channel (238) is substantially perpendicular to the alignment of the dispensing tube (233).

In a second embodiment of the present invention, the flow-control means (236) is a cam-like rotating element which position is modified by action on an associated button. It is located on the outside of the dispensing tube (233), while said dispensing tube (233) is made of an elastically deformable material. Such a construction does not require to interrupt the continuity of the dispensing tube (233), thus improving the leak-tightness of the system. The cam-like element is a substantially oval rotating roller which comprises a central rotating axis disposed perpendicular to the direction of the dispensing tube (233). When the longitudinal direction of the cam is substantially parallel to the direction of the dispensing tube (233), the liquid is free to flow through the dispensing tube (233). As soon as the user turns the button, the longitudinal direction of the cam-like element is substantially perpendicular to the direction of the dispensing tube (233), then the dispensing tube (233) is compressed and closed such as to stop the liquid flow.

Alternatively, the flow control means is mechanical as described above, but is not integrated into the spray arm. In another alternative, the flow control means is rather worked through electronic control of the rotation speed of the pump (see further description below).

The telescopingly extendible wand (232) of the spray arm (220) comprises a series of at least two tubular members (241) movably connected one to the others. For clarity purposes in the following description, it is defined that the spray arm (220) is oriented and comprises a proximal end, near the handle (231), and a distal end to which the liquid product is dispensed. The tubular members (241) can have any shape which allows to connect them so as to build a rod-like extension which can be extended or collapsed by sliding one member relatively to the preceding one. Any material may be used which provide enough resistance to flexion, while being as light as possible. Such suitable materials include for example thermoplastic resins, metals, alloys, wood fiber, carbon fiber, or a blend of these. In a preferred embodiment of the present invention, the tubular members (241) are made out of metal.

Each tubular member (241) is telescopingly engaged with and slideable along the adjacent tubular members. Preferably, each tubular member (241) is shaped such as to be free to slide inside the preceding tubular member, and such that the following tubular member is free to slide into. However, the tubular members (241) can be "positionally reversed" such that each tubular member slides along the outside of the preceding tubular member. Sliding one tubular member inward or outward with respect to the adjacent tubular members retracts or extends the telescopingly extendible wand (232) of the spray arm (220) for storage or for cleaning and to meet particular work needs.

For some tasks, the user must be able to use the spray arm (220) in intermediate lengths. For that purpose, the number of tubular members (241) is preferably more than three, more preferably more than five. In a first embodiment of the present invention, the tubular member's diameter and profile are so adjusted that, while one member is free to slide relatively to the adjacent ones, the friction coefficient between two connected members requires a certain strength to make them slide and they are not free to slide only with their own weight. Rather, the user must apply a certain strength to make them slide, and once they are set in a determined length, the friction is enough to maintain this position during use or transportation. Suitable values for the friction coefficient and suitable profile and diameter for the tubular members will be chosen adequately by those skilled in the art.

At last, in any of the preceding embodiments of the present invention, at least one portion of the proximal segment of the telescopingly extendible wand (232) of the spray arm (220) is designed to fit inside the handle (231) when the spray arm (220) is in the collapsed configuration. Preferably, the length of the telescopingly extendible wand's portion which is protruding from the handle (231), when said telescopingly extendible wand (232) is in full collapsed position, i.e. the portion which is not arranged within said handle (231), is less than 50%, preferably less than 25%, of the total length of said telescopingly extendible wand (232) in collapsed position.

The last tubular member (243), i.e. the tubular member which is the nearest from the distal end of the spray arm (220), has a distal end with one or more, preferably one nozzle member (10) secured at such end, said nozzle member being constructed as hereabove described. Optionally, the nozzle member is detachable and can be replaced by another nozzle member for which the spray pattern is different. This allows the user to selectively chose the spray pattern relatively to the surface to clean. In this case, the nozzle member is secured onto the distal tubular member of the spray arm's telescopingly extendible wand (232) by screwing, clipping or any other releasable means.

Alternatively, the nozzle member is designed so that it can be set-up to different spray patterns.

Optionally, the spraying nozzle (230) is mounted to the telescopingly extendible wand's distal segment (243) by a rotary attaching means, for example a ball/socket joint, so that said spraying nozzle (230) can be manually oriented by the user to facilitate access to surfaces to whom the access is difficult.

In a preferred embodiment of the present invention, the spray arm (220) is provided with an anti-dripping valve (244). At the time the user stops feeding the dispensing tube (233) with liquid, for example by stopping the pump of the product delivering means, (for example an electrical sprayer), there is still liquid in the tube. As a result, the liquid which remains in the tube is very likely to be spilled when the user moves the spray arm (220), or when the user collapses the telescopingly extendible wand (232) to arrange the spray arm (220). Such spillage is clearly undesirable, and it is prevented by the use of the anti-dripping valve (244). Said valve is preferably located in the distal portion of the spray arm (220), more preferably connected between the dispensing tube (233) and the nozzle member. Several anti-dripping valve (244) constructions may be applied in the present invention.

Figure 6A:
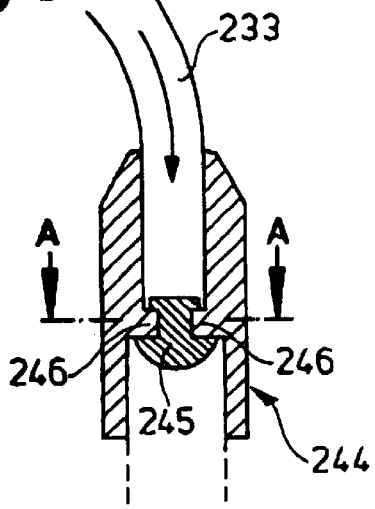
FIGS. 6 A-B-C shows the anti-dripping system with umbrella valve.
Figure 6A:
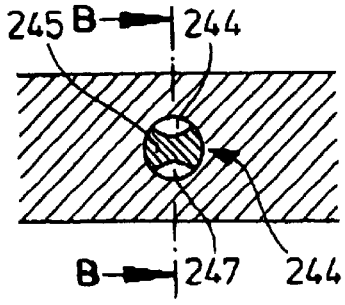
Figure 6A:
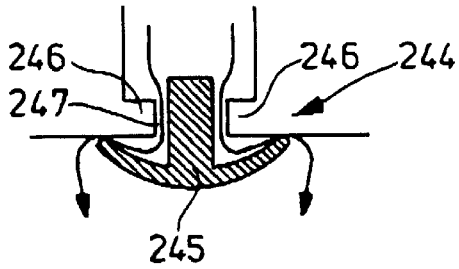

In a first embodiment, the anti-dripping valve (244) is an umbrella (245) valve, as shown in FIGS. 6A and 6B, which is integrated into a channel and secured in place by a portion (246) of the channel which has a restricted diameter. As shown in FIG. 6B, the central portion of the valve comprises liquid channels (247) through which the liquid is free to flow. As shown in FIG. 6C, the umbrella (245) portion of the valve is curved and flexible, and so positioned that it normally contacts the walls of the channel. As a result, the liquid has to deform said flexible umbrella (245) portion to flow. Such deformation can be achieved for example by pumping the liquid from the reservoir of the product delivering means (for example an electrical sprayer), however, as soon as the pump is stopped, the liquid charge inside the dispensing tube (233) is not sufficient to deform the umbrella (245), the valve closes back, and the liquid flow is stopped.

Figure 7A:
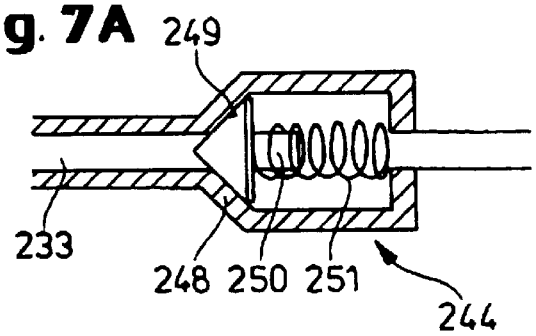
FIGS. 7 A-B shows the anti-dripping system with cone and spring elements, respectively in closed and open positions.
Figure 7B:
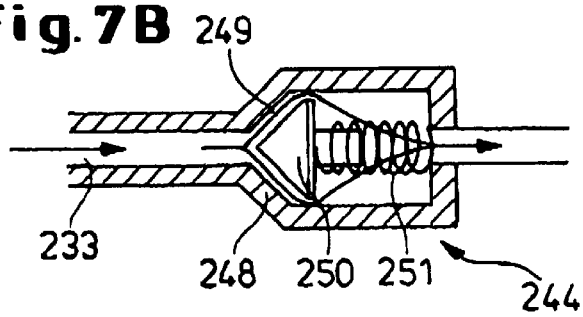
Figure 8A:
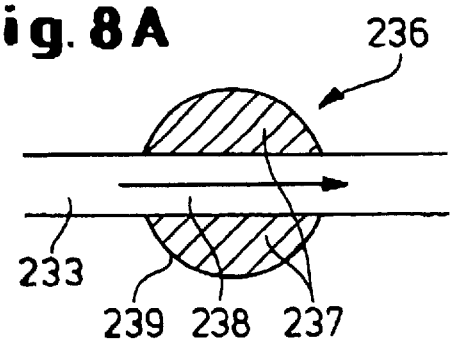
FIGS. 8 A-B-C shows the flow-control means with cylinder system, respectively in open, reduced-flow, and closed positions.
Figure 8B:
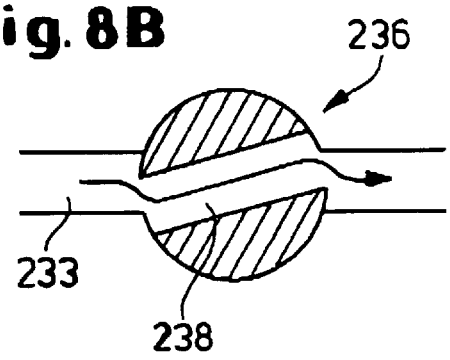
Figure 8C:
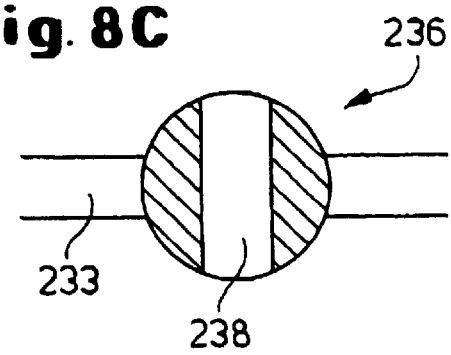
Figure 8D:
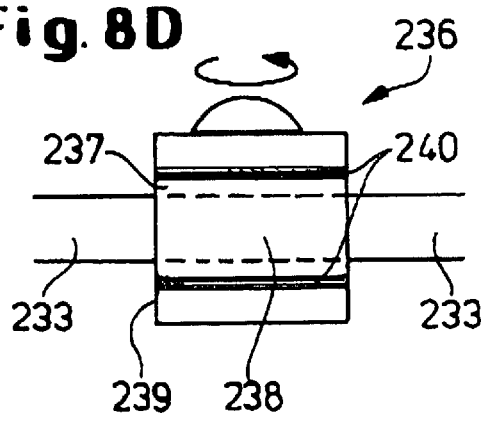

In a second embodiment of the present invention and as shown in FIGS. 7A and 7B, the valve comprises a rigid housing (248), which comprises a hollow portion with a conic wall (249). Inside the housing is also a movable cone (250), and a spring element (251) which elastically presses the cone against the conic wall (249) of the housing such as to create a liquid-tight and releasable seal. The cone is positioned so as to face the liquid flow. When the liquid charge inside the dispensing tube (233) is sufficient, for example, when the liquid is pumped from the reservoir of the product delivering means (for example an electrical sprayer), the movable cone (250) is pushed by the liquid and passes through the valve up to the nozzle member of the spray arm (220). As soon as the liquid charge inside the tube is not sufficient, for example when the pump of the electrical sprayer is stopped, the cone is pressed back against the conic wall (249) of the housing by the spring, and the liquid flow is stopped.

The spray arm (220) further comprises a dispensing tube (233) which conducts the liquid to dispense from a source, for example a reservoir or bottle connected to the product delivering means (for example an electrical sprayer), up to the nozzle member of the spray arm (220) to which it is connected in a liquid flow communication. The dispensing tube (233) is attached in at least one point to the spray arm (220). It can be of any suitable material such as for example a thermoplastic resin, natural or synthetic rubber, a metal or an alloy, or a combination of the preceding materials. Preferably, the dispensing tube (233) extends unbroken along the length of the spray arm (220), from the proximal end to the distal end. More preferably, said dispensing tube (233) is unbroken from the source of liquid, up to the nozzle member, as shown in FIG. 5. Such arrangement provides an effective cleaning solution discharge from the nozzle member regardless of relative positions of the tubular members one to the other, while providing the user with a leak-tight liquid applying spray arm (220).

In a first and preferred embodiment of the present invention, the dispensing tube (233) is attached inside the handle (231) as shown in FIG. 5, said dispensing tube (233) then comprises a coiled portion which is coiled outside the telescopingly extendible wand (232) of the spray arm (220). Preferably, said coiled portion comprises at least 10 coils (252). The distal portion of the tube is connected to the nozzle member (10) through a liquid-tight connection. The liquid flow is substantially the same in collapsed, extended or intermediate positions of the spray arm (220).

In a second embodiment of the invention, the dispensing tube (233) is linear and preferably made out of a non-extendible thermoplastic material. It is connected to the source of liquid, by its proximal end. Said dispensing tube (233) is further connected to the spray arm (220) by fish-rod like attachments, preferably in at least one point of each tubular member. Alternatively, the dispensing tube (233) can be attached only to the source of liquid, to the handle (231) of the spray arm (220), and then to the nozzle member, but without or only partial link to the telescopingly extendible wand (232) of the spray arm (220). Partial link means that the tube is attached in one or two points only to the extendible portion of the spray arm (220). Such fish-rod like attachments comprise for example annular rings (240) made out of metal, plastic or a combination of those, through which the tube is free to slide when the spray arm (220) is extended or retracted. The distal end of the tube is connected in a leak-tight way to the nozzle member of the spray arm (220).

In a third embodiment of the present invention, the dispensing tube (233) is linear and made out of a rubber-like material, preferably silicone rubber. This material gives the tube enough flexibility, so that when the spray arm (220) is extended, the dispensing tube (233) elastically extends as well, but its diameter stays substantially the same. As a result, the liquid flow through the nozzle member remains substantially the same when the spray arm (220) is in collapsed, extended, or intermediate position.

From the foregoing, it will be appreciated that the quantity of relatively heavy cleaning solution confined within the relatively small diameter dispensing tube (233) is reduced. Furthermore, the materials which are chosen for making the different elements of the spray arm (220) are light. As a result, the weight of the spray arm (220) is thereby minimized and said spray arm (220) is very easy and less-tiring to manipulate, even over long periods of time, especially when handled by women. Preferably the weight of the spray arm is less than 200 g, more preferably less than 150 g.

The Flow-control Means

The product delivering means optionally but preferably comprises a means for controlling the flow of liquid which is dispensed. This means can be mechanical, or electrical.

In a first embodiment of this invention, the flow-control means is mechanical. It can be located into the main body or handle of the product delivering means, into the reservoir, or into the extendible spray arm as described in detail above.

In a second embodiment of this invention, the flow-control means is electrical. In one embodiment of the invention, the electrical motor of the pump is connected to a means which allows the user to regulate the rotation speed of the pump, and as such, the flow of liquid which is dispensed (or pumped). In one example, said means is an electronic controller such as a potentiometer, linked to a multi-position switch, which regulates the voltage brought to the motor.

The Reservoir's Venting Means

The liquid reservoir is preferably provided with a venting means in order to allow air into the reservoir as the product is pumped out. Venting can be obtained through, for example, one way valve, venting membrane, or mechanically or electrically operated valve. Alternatively the product may be contained within a flexible bag within the liquid reservoir, so that the flexible bag collapses as the product is pumped out. The liquid reservoir is also preferably provided with a means to be releasably engaged with the pump/motor assembly. This means that when the reservoir is empty it can be removed from the pump/motor assembly and either discarded or refilled. The full liquid reservoir can then be reconnected to the pump/motor assembly for further use.

Figure 9A:
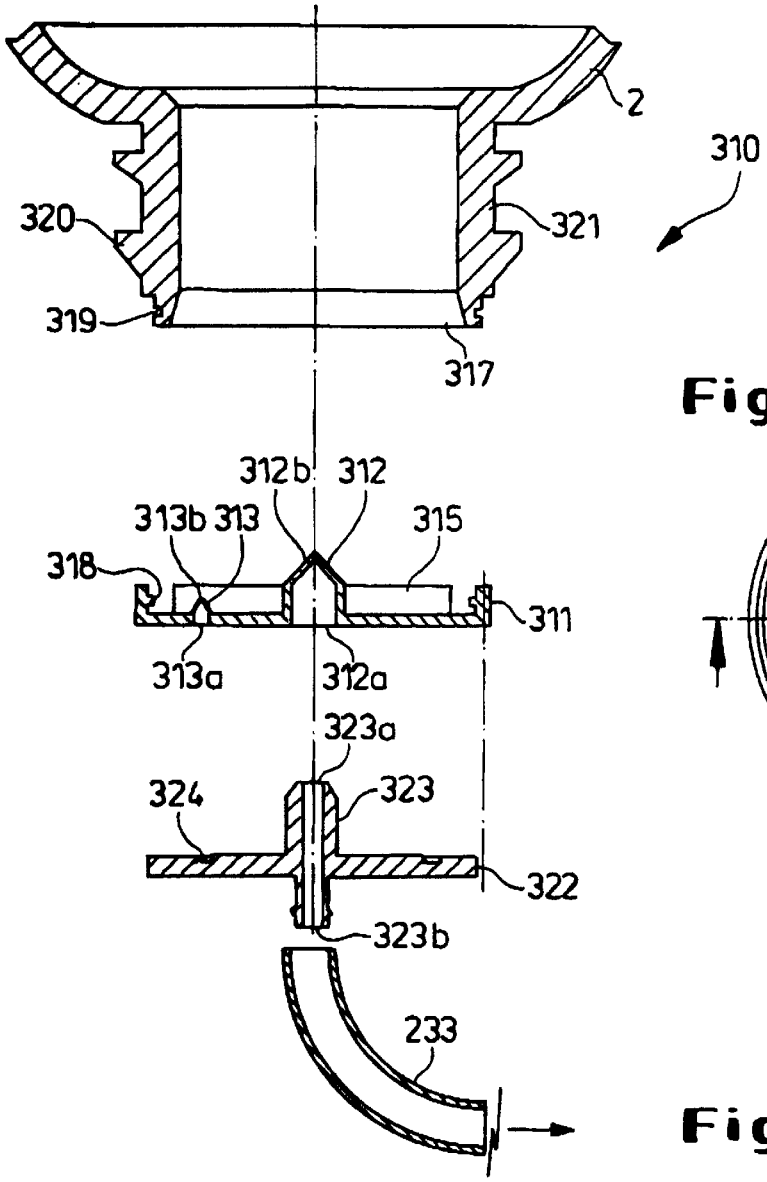
FIGS. 9*a, b, c* and 10 show the vent and fluid transfer fitment to be adapted onto the reservoir.
Figure 9B:
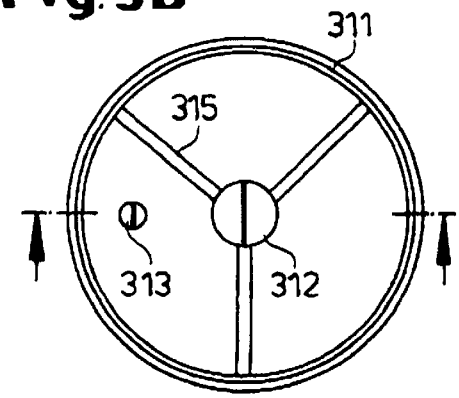
Figure 9C:
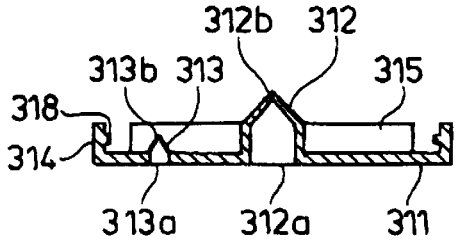
Figure 10:
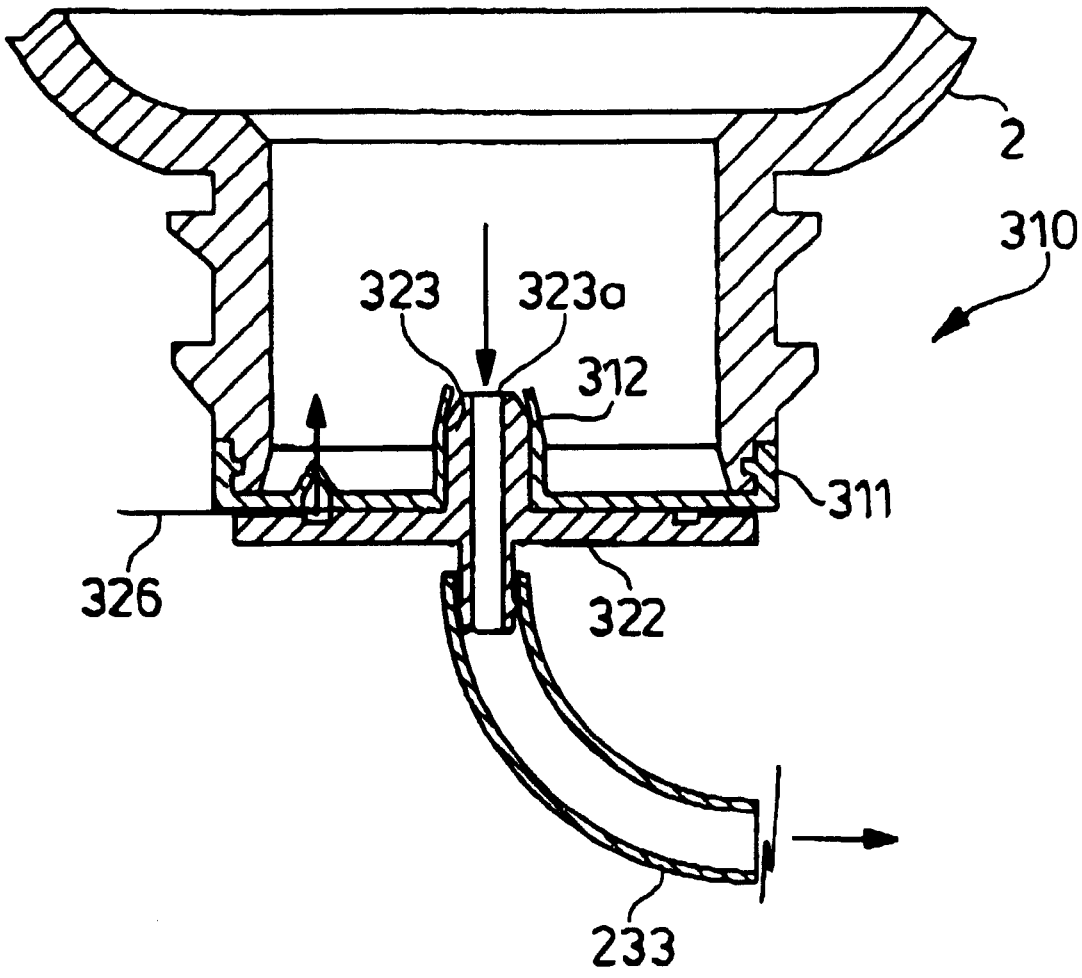

In a preferred embodiment of this invention, the liquid reservoir is a fluid filled bottle which is provided with a vent and fluid transfer fitment that allows the contents of the bottle to be vented while being transferred without the contents spilling when the bottle is inverted. Referring to FIGS. 9 and 10, the preferred vent and fluid transfer fitment (310) comprises a transfer fitment (311) having a transfer check valve (312) and a venting check valve (313) and is shown in an unassembled (FIG. 9) and an assembled (FIG. 10) configuration. The transfer fitment (311) is preferably a single molded part that contains both the transfer check valve (312) and the venting check valve (313) (FIGS. 9*a*–9*b*). However, the fitment (311) may include a cap or closure (314) in which a separate transfer check valve (312) and venting check valve (313) are inserted (FIG. 9*c*) without deviating from the intent of the invention.

In addition, the preferred transfer fitment (311) may have support ribs (315) which add stability to the transfer fitment (311) and particularly to the transfer check valve (312) as shown in FIGS. 9*a* and 9*b*. The transfer check valve (312) and the venting check valve (313) are preferably duckbill valves which have an inherent sealing pressure and which are oriented in the same direction. However, the valves (312) and (313) may comprise a variety of valves without deviating from the intent of the invention. For example, the check valves (312) and (313) may comprise umbrella valves, ball and spring check valves or a slit valve. In addition, the venting check valve (313) may be located elsewhere on the bottle (2) and/or in a different orientation without deviating from the intent of the invention.

The preferred transfer duckbill valve (312) has an open end (312*a*) and a closed "beak" end (312*b*) which remains in a closed position when the transfer duckbill valve (312) is in the relaxed state (FIG. 9*a*). The preferred venting duckbill valve (313) also has an open end (313*a*) and a closed "beak" end (313*b*) which remains in a closed position when the venting duckbill valve (312) is in the relaxed state (FIG. 9*a*).

The preferred fitment (311) is attached to a fluid filled bottle (2), specifically an opening (317), by snapping a snap bead (318) of the fitment (311) into a snap rim (319) of the bottle (2). However, the fitment (311) may be attached to the bottle (2) using screw threads (320) on a bottle finish (321) as is well known in the art. After attaching the preferred fitment (311) to the bottle (2), said bottle may be inverted without allowing the contents of the fluid within the bottle (2) to exit due to the valves (312) and (313) being in the relaxed state as seen in FIG. 9*a* and the ends (312*b*) and (313*b*) remaining closed.

The preferred fitment (311) and bottle (2) assembly is connected to a receiver attachment (322) which has a probe tip (323) and an air vent groove (324). The probe tip (323) has a first and second open end (323*a*) and (323*b*), respectively. The first open end (323*a*) of the probe tip (323) deforms and opens the "beak" end (312*b*) of the transfer duckbill valve (312) upon insertion into the open end (312*a*) (FIG. 10). The second open end (323*b*) of the probe (323) is preferably connected to a tube (233) for guiding the fluid from the bottle (2) to a pump or reservoir (not shown). However, the tube (233) and receiver attachment (322) may be formed as a single piece without deviating from the intent of the invention.

When the bottle (2) is in an inverted orientation (FIG. 9*a*), the internal static pressure acting against the "beak" end (312*b*) and (313*b*) of the duckbill valves (312) and (313), respectively, will seal the valves (312) and (313) tightly. Therefore, the valves (312) and (313) prevent fluid from prematurely flowing out of the inverted bottle (2) until the probe (323) of the receiver attachment (322) in inserted within the transfer duckbill valve (312)

Upon insertion of the receiver attachment's probe (323) into the transfer duckbill valve (312), the fluid is transferred by gravity through the probe tip (323) as it deforms and opens the transfer duckbill valve (312). As a result, a vacuum (sub-atmospheric) pressure is created within the bottle (2). When the vacuum is sufficient to overcome the sealing pressure on the venting valve (313), a bubble of air will be drawn into the bottle (2) along an air flow path (326) (FIG. 10) which quickly relieves the vacuum pressure created within the bottle (2) by the fluid exiting and resumes the sealing pressure. Preferably, the sealing pressure of the venting duckbill valve (313) is less than the sealing pressure of the transfer duckbill valve (312). As a result, the vacuum (sub-atmospheric) pressure created within the bottle (2) will cause the venting duckbill valve (313) to open and not the transfer duckbill valve (312) beyond the opening created by the displacement of the valve (312) due to the probe (323).

The air vent groove (324) in the receiver attachment (322) ensures that air can reach the venting duckbill valve (313) and be drawn into the bottle (2) when sufficient sub-atmospheric pressure is generated by the transfer of the fluid from the bottle (2). As the probe tip (323) is pushed through the transfer duckbill valve (312) (FIG. 10), the probe (323) seals along the inside wall of the duckbill valve (312). In the fully seated position (FIG. 10), the probe (323) extends through the open end (312*a*) of the duckbill valve (312) and provides a fluid path to the tube (233).

The Switch

The switch can be any suitable and ergonomic design to be operated usually by fingers or thumb. The switch can be provided with child safety features.

The Products

The products useful in the present invention are treating products providing a benefit to the surface treated. Preferably such cleaning products comprise an active ingredient, and more preferably such cleaning products comprise a surfactant. However, they can also can comprise for example laundry or cleaning products, or perfumes, as well as compositions comprising deodorizing ingredients such as cyclodextrines and substituted cyclodextrines. Such deodorizing compositions are disclosed for example in EP 0 774 978; EP 0 776 220; EP 0 774 980 and EP 0 775 229, all of the preceding patent applications/patents have been filed by the Procter & Gamble Company.

In the preferred embodiment in which the product is a cleaning composition, the most useful components include surfactant; builders; bleach and bleach activators; enzymes and enzyme stabilizers; soil release agents, chelating agents; antiredeposition agents; aqueous or non aqueous dispersing agents; brightener; suds suppressor; dye transfer inhibiting agents.

Non-limiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3—M^+)CH_3$ and $CH_3(CH_2)_y(CHOSO_3—M^+)\ CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

FIG. 1 shows a diagrammatic representation of a packaged product or device (1) comprising a liquid reservoir. The reservoir is a conventional bottle (2) with a handle (3). The device further comprises a product delivering means or unit (4) which is mounted on top of the bottle (2) and which contains the electrically driven pump (5), an electrical motor (6), and a rechargeable battery (7). An electrical circuit (not illustrated) is completed by means of a switch (8) in order to operate the motor (6) and drive the pump (5). FIG. 1 also shows a recharging socket (9). The inlet side of the pump is connected to a dip tube (10) which extends within the bottle (2) in order to remove product under vacuum from within the bottle when the pump (5) is operating. The outlet side of the pump is connected to an extendible spray arm (20) which comprises two pieces (21, 22). The two pieces are slidably connected (23) so that the spray arm can be extended to its maximum length. FIG. 1 also shows an anti-dripping valve (244) and a nozzle (230) mounted at the free end of the spray arm. By free end it is meant the end which is not connected to the pump.

Figure 2A:
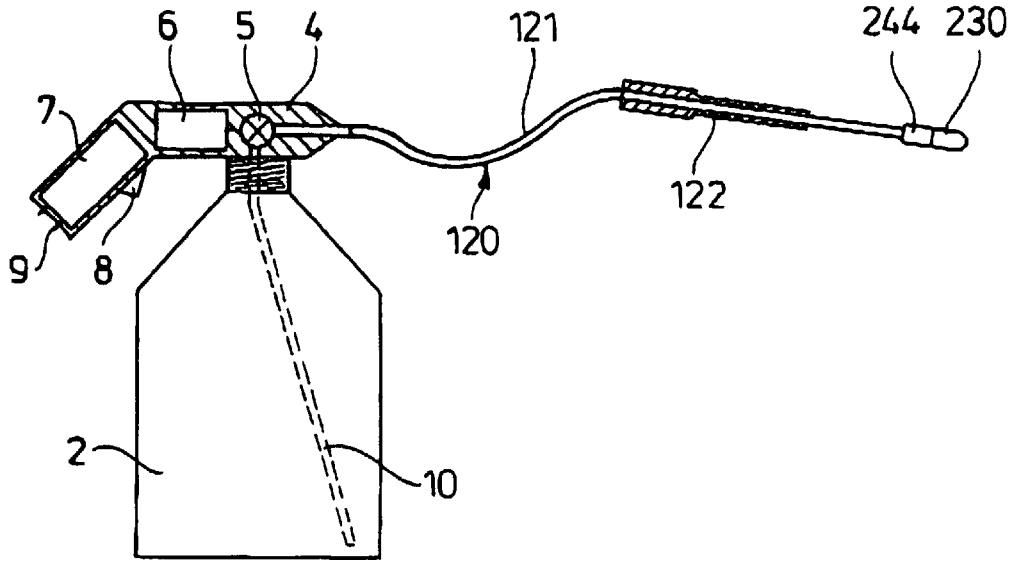
FIG. 2*a* shows a diagrammatic representation of a device which is an alternative embodiment of the invention. This embodiment has a pump mounted on the reservoir.

FIG. 2*a* shows a diagrammatic representation of a packaged product or device (1) comprising a liquid reservoir. The reservoir is a conventional bottle (2). The device further comprises a product delivering means or unit (4) which is mounted on top of the bottle (2) and which contains the electrically driven pump (5), an electrical motor (6), and a rechargeable battery (7). An electrical circuit (not illustrated) is completed by means of a switch (8) in order to operate the motor (6) and drive the pump (5). FIG. 2 also shows a recharging socket (9). The inlet side of the pump is connected to a dip tube (10) which extends within the bottle (2) in order to remove product under vacuum from within the bottle when the pump (5) is operating. The outlet side of the pump is connected to a flexible spray arm (120) which comprises a flexible portion (233) and a rigid portion (122). FIG. 2 also shows an anti-dripping valve (244) and a nozzle (230) mounted at the free end of the spray arm.

Figure 2B:
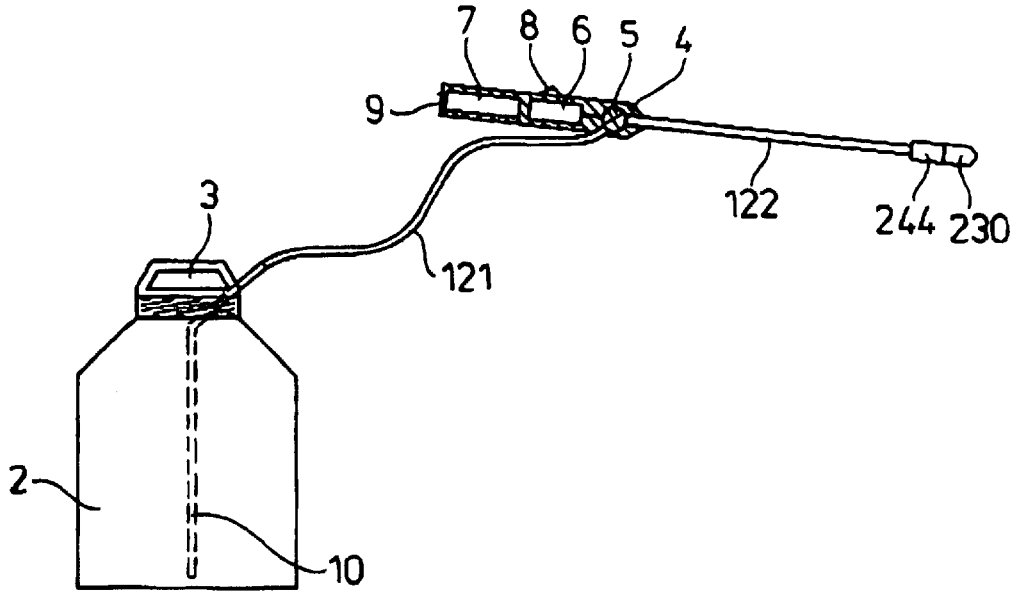
FIG. 2*b* shows a diagrammatic representation of a device which is an alternative embodiment of the invention. This embodiment has a pump mounted on the spray arm.

FIG. 2*b* shows a diagrammatic representation of a packaged product or device (1) which is similar to the device shown in FIG. 2*a*. However in FIG. 2*b* the product delivering means or unit (4) is not mounted directly on to the bottle (2). The flexible portion (233) is connected to the inlet side of the electrically driven pump (5). The dip tube (10) is formed by the free end of the flexible portion.

FIG. 3 shows a diagrammatic representation of a preferred embodiment of the packaged product or device (1) which can be used with either one hand, or with two hands. The device is shown in cut-away cross-section The device comprises a liquid reservoir which is a conventional bottle (9) from which liquid is pumped by an electrical pump/motor (5, 6) through a dispensing tube (233) to a spray arm (220). The spray arm (220) is of the preferred type as herebefore described, which comprises a handle (231), a flexible dispensing tube (233) coiled outside a telescopingly extendible wand (232), said telescopingly extendible wand (232) being partially arranged within the handle (231) when said spray arm (220) is collapsed. The housing (204) also comprises a battery (7) and a switch (8). The spray arm can be attached to the housing of the device (for example by a clipping mechanism) or can be detached from the body of the device, the device being held in one hand, and the spray arm being held in the other hand. The housing (204) is designed so that the bottle (9) is inverted when the device is held by the handle (3) for use. The advantages of this configuration are that no dip tube is required, and fully emptying the bottle is easier. Furthermore, the short distance from the liquid to the pump inlet will allow fast priming of the pump (5) when it is unprimed.

The Process

Another aspect of the present invention is directed to the use of a packaged product as described hereinbefore, for the purpose of cleaning carpets and other floor coverings, and other large surfaces (for example walls, ceilings . . . ). By cleaning, it is meant to include the notion of maintaining the appearance of said carpets, floor coverings and other large surfaces.

The packaged product described in the present application is particularly suitable for the treatment of carpets. A suitable process for treating carpets includes the steps of: (a) applying a carpet cleaning composition onto the carpet in the form of a spray of droplets having preferably a particle size distribution with a mean diameter D(v,0.9) of less than 1500 microns, more preferably less than about 1000 microns, even more preferably less than about 750 microns, and most preferably between 350 and 10 microns, the amount of composition applied onto the carpet being preferably from 1 ml to 120 ml, more preferably from about 10 to about 80 ml, and even more preferably from about 20 to about 60 ml, and yet more preferably from about 30 to about 50 ml, per square meter of carpet, and (b) leaving said composition to dry onto the carpet, and (c) optionally removing it by vacuum cleaning said carpet, said composition preferably being selected from those described in the applications incorporated herein by reference and having preferably a residuality index of less than 40%, more preferably less than about 60%, after drying and after vacuum cleaning with a conventional vacuum cleaner, such as for example a Hoover® 1300W standard implement for carpet.

By "dry" it is meant herein the stage where at least 40%, preferably at least 60% of the initial amount of composition dispensed onto the carpet is lost due to evaporation.

The residuality index after vacuum cleaning (TVRi) is defined as follow:

$$TVRi\ (\%) = \frac{Wfv - Ws}{Wt - Ws} \times 100$$

wherein:

Ws represents the initial weight of a carpet sample (prior to any treatment);

Wt represents the weight of the same carpet sample immediately after the composition for the cleaning of the carpet has been applied thereto; Wt may be influenced by the composition application rate (gr $m^{-2}$ $s^{-1}$) and/or the application time (seconds);

Wfv represents the final weight of the same carpet sample after having been vacuumed with an Hoover® 1300W standard implement for carpet.

Ws, Wt and Wfv can be expressed in any weight unit provided that the same. unit is used for the three parameters.

A suitable test method to determine the residuality index is the one mentioned as follows:

A square 10 ×10 cm carpet sample is weighted before and after submitting it to a vacuum cleaning with a Hoover® 1300W for 10 seconds. In order to avoid interference of the weight lost of the carpet itself (e.g. fibers) when submitted to vacuum cleaning in the determination of the residuality index it is important to repeat the vacuum cleaning several times as required and weight the carpet sample thereafter, unless the weight loss due to the vacuuming is less than 5% of composition dosage (i.e., for a sample of 100 $cm^2$ and a dosage of 50 gr/$m^2$, the loss due to vacuuming has to be less than 0.025 gr). The latest weight for the carpet sample following the hereinbefore procedure is Ws.

Then the composition is sprayed onto the carpet in amount of 50 gr/$m^2$ and the sample is weighted thereafter to determine Wt. Then the composition is left to dry 60 minutes and vacuum cleaned with a Hoover® 1300 W for 10 seconds. The step of leaving the composition to dry on the carpet is of course performed under "normal temperature" and "normal humidity conditions". By "normal temperature conditions" it is meant herein, from 15° C. to 25° C., preferably from 20° C. to 25° C. By "normal humidity conditions" it is meant herein, from 40%RH (%-relative humidity) to 80%RH, preferably from 50%RH to 65%RH. Finally the sample is weighted again to determine Wfv. The residuality index should preferably be at least about 40%, more preferably at least about 60%, and even more preferably at least about 80%.

The method is especially useful for carpets that are new, or in near new condition, and which are therefore not highly soiled. It is advantageous to clean such carpets on a regular basis, at least about once every two months, preferably at least once a month, more preferably at least once a week, and even more preferably at every few days, e.g, from about 1–6, preferably 2–5 days. Soil that is left on a carpet tends to migrate to the lower part of the carpet and/or get ground into the fibers and/or backing thus making removal more difficult. The advantage of frequent cleaning is that the carpet lasts longer and is in acceptable shape for a longer period of time. In order to clean on a frequent basis, it is necessary to use a non-manually operated sprayer to avoid making the consumer tire of the effort. By "non-manually operated" it is meant that the spray dispenser can be manually activated, but the force required to conduct the product from the reservoir to the dispensing nozzle is provided by another, non-manual means.

Most preferably, the spray dispenser is a non-aerosol, mechanically or electrically activated, pump-spray dispenser, especially as disclosed hereinbefore. As previously described, said dispenser comprises a reservoir, a spray arm with dispensing nozzle, and a means for conducting product from the reservoir to the dispensing nozzle, said means being preferably a pump mechanism which securely screws or snaps onto the reservoir. The reservoir comprises a vessel for containing the carpet cleaning composition to be dispensed. The reservoir can be constructed of any conventional material including, but not limited to: polyethylene; polypropylene; polyethyleneterephthalate (PET); blends of polyethylene, vinyl acetate, and rubber elastomer. A preferred reservoir is made of clear material, e.g., polyethylene terephthalate (PET). Other materials can include stainless steel.

Other types of non-manually operated dispensers can also be used which comprise a wide variety of dispensers as listed in the following examples. For example, aerosol dispensers can be used although they are environmentally undesirable and quite expensive. Said aerosol dispensers comprise a container which can be constructed of any of the conventional materials employed in fabricating aerosol containers. The dispenser must be capable of withstanding internal pressure in the range of from about 20 to about 110 p.s.i.g., more preferably from about 20 to about 70 p.s.i.g. The one important requirement concerning the dispenser is that it be provided with a valve member which will permit the carpet cleaning composition contained in the dispenser to be dispensed in the form of a spray of very fine, or finely divided. particles or droplets as set forth hereinbefore. The aerosol dispenser utilizes a pressurized sealed container from which the clear, aqueous de-wrinkle composition is dispensed through a special actuator/valve assembly under pressure. The aerosol dispenser is pressurized by incorporating therein a gaseous component generally known as a propellant. Common aerosol propellants, e.g., gaseous hydrocarbons such as isobutane, and mixed halogenated hydrocarbons, can be used. Halogenated hydrocarbon propellants such as chlorofluoro hydrocarbons have been alleged to contribute to environmental problems, and are not preferred. When cyclodextrin is present in the carpet cleaning composition for odor control reasons, hydrocarbon propellants are not preferred, because they can form complexes with the cyclodextrin molecules thereby reducing the availability of uncomplexed cyclodextrin molecules for odor absorption. Preferred propellants are compressed air, nitrogen, inert gases, carbon dioxide, etc. A more complete description of commercially available aerosol-spray dispensers appears in U.S. Pat. No. 3,436,772, Stebbins, issued Apr. 8, 1969; and U.S. Pat. No. 3,600,325, Kaufman et al., issued Aug. 17, 1971; both of said references are incorporated herein by reference.

Preferably the spray dispenser can be a self-pressurized non-aerosol container having a convoluted liner and an elastomeric sleeve. Said self-pressurized dispenser comprises a liner/sleeve assembly containing a thin, flexible radially expandable convoluted plastic liner of from about 0.010 to about 0.020 inch (i.e. from about 0.025 to 0.051 cm) thick, inside an essentially cylindrical elastomeric sleeve. The liner/sleeve is capable of holding a substantial quantity of carpet cleaning composition product and of causing said product to be dispensed. A more complete description of self-pressurized spray dispensers can be found in U.S. Pat. No. 5,111,971, Winer, issued May 12, 1992, and U.S. Pat. No. 5,232,126, Winer, issued Aug. 3, 1993; both of said references are herein incorporated by reference. Another type of aerosol spray dispenser is one wherein a barrier separates the carpet cleaning composition from the propellant (preferably compressed air or nitrogen), as disclosed in U.S. Pat. No. 4,260,110, issued Apr. 7, 1981, and incorporated herein by reference. Such a dispenser is available from EP Spray Systems, East Hanover, N.J.

Other non-manually operated sprayers include, but are not limited to, powered sprayers other than the preferred ones disclosed hereinbefore, air aspirated sprayers, liquid aspirated sprayers, electrostatic sprayers, and nebulizer sprayers. The carpet cleaning composition is placed into a spray dispenser in order to be distributed onto the fabric.

Powered sprayers include self contained powered pumps that pressurize the aqueous odor absorbing composition and dispense it through a nozzle to produce a spray of liquid droplets. Powered sprayers are attached directly or remotely through the use of piping/tubing to a reservoir (such as a bottle) to hold the carpet cleaning composition. Powered sprayers may include, but are not limited to, centrifugal or positive displacement designs. It is preferred that the powered sprayer be powered by a portable DC electrical current from either disposable batteries (such as commercially available alkaline batteries) or rechargeable battery units (such as commercially available nickel cadmium battery units). Powered sprayers may also be powered by standard AC power supply available in most buildings.

Nonlimiting examples of commercially available powered sprayers are disclosed in U.S. Pat. No. 4,865,255, Luvisotto, issued Sep. 12, 1989 which is incorporated herein by reference. Preferred powered sprayers are readily available from suppliers such as Solo, Newport News, Va. (e.g., Solo Spraystar™ rechargeable sprayer, listed as manual part #: U.S. Pat. No. 460, 395) and Multi-sprayer Systems, Minneapolis, Minn. (e.g., model: Spray 1).

Air aspirated sprayers include the classification of sprayers generically known as "air brushes". A stream of pressurized air draws up the aqueous odor absorbing composition and dispenses it through a nozzle to create a spray of liquid. The odor absorbing composition can be supplied via separate piping/tubing or more commonly is contained in a jar to which the aspirating sprayer is attached.

Nonlimiting examples of commercially available air aspirated sprayers appears in U.S. Pat. No. 1,536,352, Murray, issued Apr. 22, 1924 and U.S. Pat. No. 4,221,339, Yoshikawa, issues Sep. 9, 1980; all of said references are incorporated herein by reference. Air aspirated sprayers are readily available from suppliers such as The Badger Air-Brush Co, Franklin Park, Ill. (e.g., model #: 155) and Wilton Air Brush Equipment, Woodridge, Ill. (e.g., stock #: 415-4000, 415-4001, 415-4100).

Liquid aspirated sprayers are typical of the variety in widespread use to spray garden chemicals. The aqueous odor absorbing composition is drawn into a fluid stream by means of suction created by a Venturi effect. The high turbulence serves to mix the aqueous odor absorbing composition with the fluid stream (typically water) in order to provide a uniform mixture/concentration. It is possible with this method of delivery to dispense the aqueous concentrated odor absorbing composition of the present invention and then dilute it to a selected concentration with the delivery stream.

Liquid aspirated sprayers are readily available from suppliers such as Chapin Manufacturing Works, Batavia, N.Y. (e.g., model #: 6006).

Electrostatic sprayers impart energy to the aqueous odor absorbing composition via a high electrical potential. This energy serves to atomize and charge the aqueous odor absorbing composition, creating a spray of fine, charged particles. As the charged particles are carried away from the sprayer, their common charge causes them to repel one another. This has two effects before the spray reaches the target. First, it expands the total spray mist. This is especially important when spraying to fairly distant, large areas. The second effect is maintenance of original particle size. Because the particles repel one another, they resist collecting together into large, heavier particles like uncharged particles do. This lessens gravity's influence, and increases the charged particle reaching the target. As the mass of negatively charged particles approach the target, they push electrons inside the target inwardly, leaving all the exposed surfaces of the target with a temporary positive charge. The resulting attraction between the particles and the target overrides the influences of gravity and inertia. As each particle deposits on the target, that spot on the target becomes neutralized and no longer attractive. Therefore, the next free particle is attracted to the spot immediately adjacent and the sequence continues until the entire surface of the target is covered. Hence, charged particles improve distribution and reduce drippage.

Nonlimiting examples of commercially available electrostatic sprayers appears in U.S. Pat. No. 5,222,664, Noakes, issued Jun. 29, 1993; U.S. Pat. No. 4,962,885, Coffee, issued Oct. 16, 1990; U.S. Pat. No. 2,695,002, Miller, issued November 1954; U.S. Pat. No. 5,405,090, Greene, issued Apr. 11, 1995; U.S. Pat. No. 4,752,034, Kuhn, issued Jun. 21, 1988; U.S. Pat. No. 2,989,241, Badger, issued June 1961; all of said patents are incorporated herein by reference. Electrostatic sprayers are readily available from suppliers such as Tae In Tech Co, South Korea and Spectrum, Houston, Tex.

Nebulizer sprayers impart energy to the aqueous odor absorbing composition via ultrasonic energy supplied via a transducer. This energy results in the aqueous odor absorbing composition to be atomized. Various types of nebulizers include, but are not limited to, heated, ultrasonic, gas, venturi, and refillable nebulizers.

Nonlimiting examples of commercially available nebulizer sprayers appears in U.S. Pat. No. 3,901,443, Mitsui, issued Aug. 26, 1975; U.S. Pat. No. 2,847,248, Schmitt, issued Aug. 1958; U.S. Pat. No. 5,511,726, Greenspan, issued Apr. 30, 1996; all of said patents are incorporated herein by reference. Nebulizer sprayers are readily available from suppliers such as A&D Engineering, Inc., Milpitas, Calif. (e.g., model A&D Un-231 ultrasonic handy nebulizer) and Amici, Inc., Spring City, Pa. (model: swirler nebulizer).

A preferred article of manufacture herein comprises a non-manually operated sprayer, such as a battery-powered sprayer, and especially the one disclosed hereinbefore, containing the carpet cleaning composition. More preferably the article of manufacture comprises a combination of a non-manually operated sprayer and a separate container of the carpet cleaning composition, to be added to the sprayer before use and/or to be separated for filling/refilling. The separate container can contain a usage composition, or a concentrated composition to be diluted before use, and/or to be used with a diluting sprayer, such as with a liquid aspirated sprayer, as described herein above. Also, the separate container should have structure that mates with the rest of the sprayer to ensure a solid fit without leakage, even after motion, impact, etc. and when handled by inexperienced consumers.

A desirable article of manufacture can also comprise a non-manually operated sprayer and/or carpet cleaning composition, preferably one that is substantially (e. g., > about 40%) in a reservoir in association with a set of instructions to use the article in a process (method) as described hereinbefore which is preferably limited as to particle size and/or level of application and/or drying and/or vacuuming, so as to clean carpets and especially to treat the carpets, and especially those that are new, or new in appearance, with the desired frequency of treatment so as to maintain the appearance and/or condition of the carpets. It is essential to inform the consumer that the treatment can be used with this frequency, especially since the large amount of active cleaning ingredients is removed. Optionally, when the composition contains hydrogen peroxide and/or polymer as disclosed herein, it is important to advise the consumer that the treatment will provide a solution to problems involving and/or provision of a benefit related to those selected from the group consisting of: killing or reducing microbes; softening; reducing time and/or effort involved in cleaning carpets, reducing static; making the surface appear "fluffier"; and/or reduction in odors. It is important that the consumer be aware of these additional benefits, since otherwise the consumer would not know that the composition would solve these problems and/or provide these benefits.

As used herein, the phrase "in association with" means the set of instructions are either directly printed on the reservoir itself or presented in a separate manner including, but not limited to, a brochure, print advertisement, electronic advertisement, and/or verbal communication, so as to communicate the set of instructions to a consumer of the article of manufacture. The set of instructions preferably comprises the instruction to apply an effective amount of the composition, preferably by spraying, to provide the indicated benefit, e.g. maintenance of carpet appearance, softness, and/or fluffy appearance; antimicrobial action; anti-static effect, and/or reduction in time and/or effort of cleaning and, optionally, the provision of odor control and/or reduction and reduction in microbial contamination and/or insects.

What is claimed is:

1. A process of treating carpets and other large fabric coverings comprising the steps of:

providing a hand-held device having a reservoir filled with a liquid product and means for dispensing said liquid product, wherein said dispensing means comprises an electrically driven pump having an electrical power source housed in said device, a spray arm and at least one dispensing opening wherein said reservoir is removable and wherein said reservoir is releasably connected to said pump through a liquid-tight vent and fluid transfer fitment, said fitment comprising:

(i) a liquid transfer check valve for allowing passage of liquid from said reservoir to said pump; and (ii) a venting check valve for allowing air to displace the liquid when said liquid exits said reservoir, both valves having an inherent sealing pressure created by the static pressure of the liquid within the reservoir; and dispensing said liquid product onto said carpet or said large fabric coverings.

2. The process according to claim 1, wherein the reservoir is not refillable.

3. The process according to claim 1, wherein said electrical power source has at least one rechargeable battery.

4. The process according to claim 1, wherein said at least one reservoir comprises at least one compartment.

5. The process according to claim 1, further comprising at least one fitment for interconnecting a cartridge of a concentrated product to be mixed with said at least one reservoir's contents.

6. The process of claim 1 wherein said spray arm is detachable and further comprising the steps of detaching said spray arm from said device prior to the step of dispensing said liquid product.

7. The process of claim 6 wherein said spray arm is extendible and further comprising the steps of extending said spray arm prior to the step of dispensing said liquid product.

8. The process of claim 1 wherein said spray arm comprises a handle, a telescopingly extendible wand connected to said handle and at least one product dispensing nozzle in fluid communication with said pump, said dispensing nozzle being connected to said spray arm.

9. The process of claim 8 wherein said liquid product has a residuality index of less than about 40%.

10. The process of claim 1 further comprising the step of vacuuming said carpet or said large fabric coverings.

11. The process of claim 10 wherein at least 40% of said liquid product is left to dry onto said carpet or said large fabric coverings prior to the step of vacuuming said carpet or said large fabric coverings.

* * * * *